US006354222B1

(12) United States Patent
Becker et al.

(10) Patent No.: US 6,354,222 B1
(45) Date of Patent: Mar. 12, 2002

(54) PROJECTILE FOR THE DESTRUCTION OF LARGE EXPLOSIVE TARGETS

(75) Inventors: Robert S. Becker, Maple Grove; Kelly D. McHenry, Minnetonka; Frederick J. Wagener, St. Louis Park, all of MN (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/542,344

(22) Filed: Apr. 5, 2000

(51) Int. Cl.[7] ..... F42B 11/20

(52) U.S. Cl. ..... 102/513; 102/513; 102/323; 102/367

(58) Field of Search ..... 102/323, 367, 102/513, 364

(56) References Cited

U.S. PATENT DOCUMENTS

| | | | | |
|---|---|---|---|---|
| 1,333,834 A | | 3/1920 | Clay | |
| 1,432,669 A | * | 10/1922 | Clay | 102/513 |
| 3,750,585 A | * | 8/1973 | Feldman | 102/513 |
| 3,788,908 A | * | 1/1974 | Lehikoinen et al. | 102/513 |
| 3,983,818 A | | 10/1976 | Ciccone et al. | |
| 4,112,846 A | * | 9/1978 | Gilbert et al. | 102/513 |
| 4,331,080 A | | 5/1982 | West et al. | |
| 4,402,776 A | * | 9/1983 | Whipps | |
| 4,432,818 A | * | 2/1984 | Givens | |
| 4,495,870 A | * | 1/1985 | Bell | 102/511 |
| 5,212,343 A | * | 5/1993 | Brupbacher et al. | 102/323 |
| 5,464,699 A | * | 11/1995 | Baldi | |
| 6,013,144 A | * | 1/2000 | Callaway | 149/108.2 |

FOREIGN PATENT DOCUMENTS

| | | |
|---|---|---|
| DE | 39 37 464 A | 5/1991 |

* cited by examiner

*Primary Examiner*—Michael J. Carone
*Assistant Examiner*—Lulit Semunegus
(74) *Attorney, Agent, or Firm*—Daly, Crowley & Mofford, LLP

(57) ABSTRACT

A projectile and method for the destruction of normally explosive targets and includes a projectile shell body containing a pyrogenically activated intermetallic reactive payload in the forward section of the shell and an amount of tracer material aft of the payload in the shell body for igniting the intermediate reactive payload. The tracer material is ignited by the shell propellant upon launch.

6 Claims, 2 Drawing Sheets

PROJECTILE FOR THE DESTRUCTION OF LARGE EXPLOSIVE TARGETS

STATEMENTS REGARDING FEDERALLY SPONSORED RESEARCH

Not applicable.

CROSS-REFERENCE TO RELATED APPLICATIONS

Not applicable.

BACKGROUND OF THE INVENTION

I. Field of the Invention

This invention relates generally to ammunition and explosives and, more particularly, to an incendiary munition projectile which is particularly well adapted for use in destroying large nominally explosive targets, but which is also advantageously usable for other ordinance applications. Projectiles of the present invention are Well adapted to be fired from relatively small caliber, rapid fire guns in the 20 mm to 40 mm class. Construction is accomplished by benign incineration utilizing a tracer ignited, pyrogenically activated intermetallic reactive payload in a conventional projectile.

II. Related Art

Pyrogenically activated compositions are commonly utilized in military ammunition to produce visible or tracer rounds which have long been included in multiple round firing guns as every nTH round to produce a serial spaced sequential representation of the trajectory or path of each tracer projectile which is visible to the operator of the weapon to permit the operator or an observer to observe and follow the path of each tracer projectile and follow the round between launch from the firing piece and the intended target. The percentage of tracer rounds and the total number of rounds can vary from a relatively high to a relatively low percentage depending on the application and such ace included in almost every rapid fire armament ammunition.

As is the case with many other pyrotechnic compositions, tracer compositions are basically a mixture of an oxidizing agent and a metallic fuel often utilized in conjunction with other materials added to the mixture to modify the burning rate, visual effect and to increase handling safety. Typical metallic fuel materials include magnesium and aluminum and typical oxidizing materials include strontium nitrate. These compositions are normally held together with a binder material which may also act as a color intensifier if it contains chlorine or fluorine, a water proofing agent and/or a flame retardant material.

The tracer material is designed to be ignited by the projectile propellant and thereafter maintain a sufficiently intense visible lumination such that the projectile flight can be followed to the target. In most cases, the tracer has no discrete ignition effect on the target at all, but may, on occasion, ignite fires in fossil fuels or the like.

Many large explosive-containing targets exist that need to be safely destroyed as by deflagration or detonation from a safe distance. These include mines, torpedo warheads or unexploded bombs, or the like, which may come within range of relatively small caliber guns in the 20 MM–40 MM range. It would be a great advantage if such weapons could be used unmodified to destroy such targets, i.e., with no more preparation time than is needed to aim the gun at the target. Thus, there exists a need for a standardized projectile round which can be fired by such a gun, unmodified and that will destroy certain large explosive targets which are difficult or impossible to destroy safely with conventional rounds. In addition, it would be desirable if such projectile could accomplish destruction of such large explosive targets generally without detonation of the explosives contained in the targets.

SUMMARY OF THE INVENTION

Accordingly, in view of the above, it is a primary object of the present invention to provide a projectile for the destruction of large, nominally explosive targets which can be fired from a conventional, unmodified weapon. Another object of the present invention is to provide a projectile for the destruction of large explosive targets which infuses heat into the explosive material to achieve deflagration.

A further object of the present invention is to provide a projectile for the destruction of large explosive targets which utilizes a pyrogenically activated intermetallic payload to produce a temperature in the range necessary to destroy the explosive material by deflagration.

A still further object of the present invention is to provide a projectile for the destruction of large explosive targets utilizing a pyrogenically activated intermetallic reactive payload which is ignited post launch by an amount of tracer material in the projectile.

A yet still further object of the present invention is to provide a projectile for the destruction of large explosive targets which utilizes an intermetallic reactive payload selected bi-metallic constituent systems selected from titanium and boron and nickel and aluminum.

Other objects and advantages will occur to those skilled in the art upon familiarization with the descriptions and accounts contained in the specification, drawing s and claims of the application.

In the means of the present invention, there is provided a projectile for the destruction of large, nominally explosive targets which is of conventional size and weight such that it can be fired along with other ammunition from the conventional, unmodified gun system. The projectile concept of the invention allows the delivery of a high temperature (2000° C. or more) payload at long standoffs to accomplish the destruction via deflagration or detonation at a safe distance. The system can be used on large targets such as mines, torpedo warheads or unexploded bombs. The projectile concept of the invention utilizes launch propellant to initiate tracer material which, in turn, ignites the payload post launch. The nose of the projectile can be equipped with a conventional or a high intrusion penetrator system in the forward nose section as preferably configures to have conventional ballistics with respect to a typical round utilized in the gun of interest.

The projectile of the invention includes a generally hollow conventional projectile shell body having a tapered forward nose section and an aft section with the nose section being filled with a pyrogenically activated intermetallic reactive (IMR) payload in the forward section. An amount of tracer igniter material is loaded behind the intermetallic reactive material payload and in contact with it. Upon firing, the tracer is ignited by the shell propellant in a conventional manner and it, in turn, ignites the intermetallic reactive material payload after a pre-determined reacting time to allow safe separation from the launching platform prior to payload ignition. The heat from the tracer compound starts the reaction in the intermetallic reactive payload. The payload forms a new solid at a very high temperature (2000° C. or more) before the projectile strikes the target. Upon impact, the projectile breaks up in a controlled fashion, distributing hot fragments throughout the high explosive target causing deflagration. In this manner, an extremely hat wave front is propagated in the target which subsequently ignites on impact. If desired, a penetrator nose can be used in the shell to increase projectile intrusion.

With respect to the payload itself, the preferred material for the intermetallic reactive payload is a bimetallic reactive material selected from titanium and boron, which produce titanium boride (TiB) and nickel and aluminum which produce nickel aluminide (NiAl). The tracer material may be any standard tracer compound combination available, such as magnesium and strontium nitrate, and used for ammunition of the class of interest and no special tracer material need be employed. If necessary, binders such as Polytetrafluoroethylene (PTFE) or other materials to modify the reaction rats or progression can be put in the material as additives. The ballistics of the projectiles of the invention are generally conventional, although small amounts of gaseous bi-product given off by the high temperature reaction may cause some additional drag effects which may be otherwise compensated for in the construction of the cartridge or the propellant load.

BRIEF DESCRIPTION OF THE DRAWINGS

The foregoing features of this invention, as well as the invention itself, may be more fully understood from the following description of the drawings in which.

DETAILED DESCRIPTION OF THE INVENTION

The primary thrust of the present invention involves a unique incendiary projectile and method for the destruction of normally explosive targets, by deflagration which can be handled by existing rapid fire guns without modification. The projectile uses a tracer material ignited by the launching burn to pyrogenically activated intermetallic payload post launch which is designed to impact the target in a manner so as to distribute hot fragments throughout the high explosive material of the target thereby causing deflagration. In this regard, the particular projectiles and particular ingredients of the intermetallic reactive (IMR) payload disclosed are intended to be exemplary rather than limiting with respect to the inventive concept described.

Figure 1:
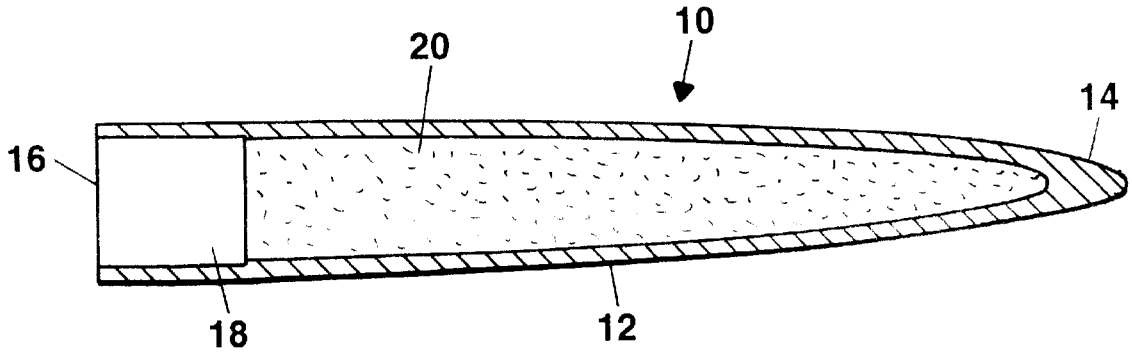
FIG. 1 is a schematic drawing, partially in section, representing a typical projectile body containing an intermetallic reactive material payload in accordance with the invention.

FIG. 1 depicts a schematic drawing, partially in section, representing a typical projectile body 10 having a metallic casing 12 and including a relatively heavy gauge penetrating ogive nose section 14 and an open tail or aft section at 16. The casing 12 is filled with a segmented charge of two materials including a tracer-igniter material at 18 and the intermetallic reactive payload material shown at 20.

Figure 2:
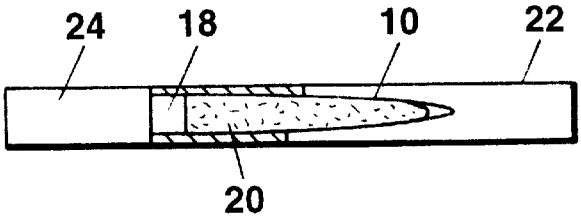
FIG. 2 is a reduced schematic drawing representing the shell of FIG. 1 traveling in a launching barrel just after the propellant is ignited.
Figure 3:
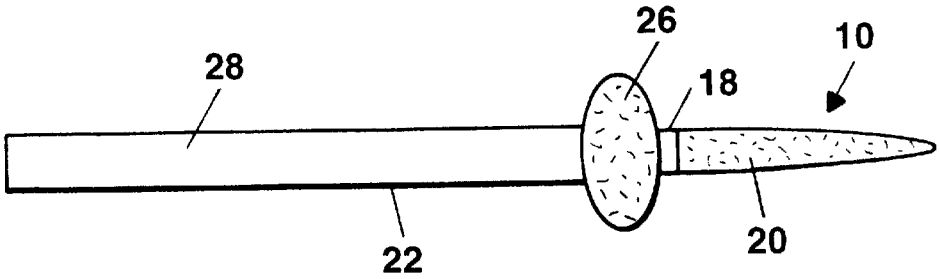
FIG. 3 is a schematic drawing similar to FIG. 2 showing the ignition of the tracer compound by the propellant at launch.

FIGS. 2–6 depict the sequence of operation of the projectile of FIG. 1 with FIG. 2 depicting the projectile 10 after propellant ignition, but prior to launch as it moves along a launching barrel 22 propelled by an ever-increasing volume of propellant gases at 24. FIG. 3 depicts the ignition of the tracer material 18 at 26 as the projectile 10 emerges from the barrel 22, the propellant gases having expanded as at 28.

Figure 4:
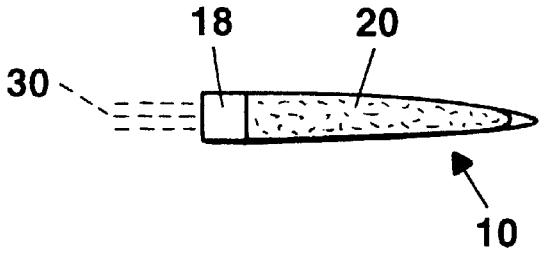
FIG. 4 depicts the projectile in flight with the tracer compound burning for a pre-set time and igniting the IMR payload post launch.
Figure 5:
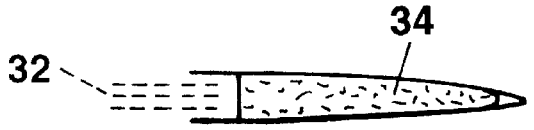
FIG. 5 is a drawing similar to FIG. 4 showing the IMR payload reacting and venting out the aft section of the shell.

FIG. 4 depicts the burning of the tracer compound at 18 with some gas venting at 30. The amount of tracer compound included enables it to burn for a pre-determined set time prior to igniting the IMR payload 20 which, is further shown reacting in FIG. 5 and venting additional material out the rear as shown at 32. The reaction of the IMR payload material 20 creates an extremely hot, brittle solid material as depicted at 34 in FIG. 5.

Figure 6:
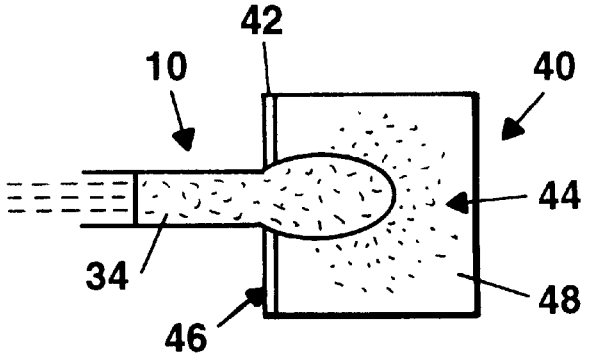
FIG. 6 is a schematic diagram of the projectile of the invention penetrating a typical target and distributing a pattern of hot payload fragments into the target.

FIG. 6 depicts the projectile 10 impacting a target 40 with the nose portion 14 (not shown) penetrating the sidewall 42 of the target 40 and the forward portion of the casing 12 breaking apart and distributing a pattern 44 of extremely hot payload fragments 46 into the explosive material 48 occupying the target 40. The hot payload fragments, in turn, preferably cause the explosive material 48 in the target 40 to undergo deflagration rather than to explode but, in any event, to be destroyed and rendered non-energetic. It will be appreciated that the bi-metallic or intermetallic reactants of the projectile of the invention create a brittle solid material having a very high temperature, i.e., 2000° C. or greater maintained inside the projectile shell 12 until impact with the target at which time the relatively heavy nose section 14 penetrates the target wall and the casing wall 12 fails allowing the high temperature brittle solid material 34 to disintegrate into a pattern of hot fragments which can be distributed throughout a large volume of the energetic material sought to be destroyed. It should be noted that a penetrator can be included in the projectile in a well-known manner in accordance with the invention if higher intrusion effect is required.

In accordance with the illustrative figures, it should be noted that the ignition of the tracer material occurs conventionally and that the relatively high temperature IMR is not ignited until some time has elapsed after launch so that problems associated with premature ignition which might occur on the barrel of a launching vehicle are avoided. Venting of a payload out the rear as it reacts to form the high temperature brittle mass may effect the ballistic characteristics of the projectile 10, however, this effect can be predicted with relative certainty so that compensation for additional drag or other ballistic effects can be included in the original proiectile design.

With respect to the payload itself, the preferred material for the intermetallic reactive payload may be any of several bi-metallic reactive combinations including combinations of titanium and boron which produce titanium boride (TiB) and nickel aluminum which react to produce nickel aluminide (NiAl). It is anticipated, however, that other similar acting combination might find use in the projectiles depending on the particular application involved. The tracer material may be any standard tracer compound, as previously indicated, such as the combination of magnesium and strontium nitrate, or the like, which is used for ammunition of the class with which the projectile around the present invention can be interchangeably used and no special tracer material is required.

The ingredients of the bimetallic reactive payload 20 material are preferably in finely divided particulate form, the particles having an average size of approximately 10 microns and thoroughly mixed in stolchemetric proportions and packed into the forward portion of the projectile 10. Binders such as polytetrafluoroethylene or other inert materials can be utilized to modulate the reaction rate or amount and type of gas vented during the reaction of the bimetallic material.

In the manner described above, the projectile of the invention can deliver a pattern of very high temperature and incendiary fragments into an energetic load a safe distance from the load to initiate deflagration or detonation of the load in a manner that will do no energetic harm. The projectiles may be used for destroying energetic materials in both land and undersea mines, bombs, shells and other cased explosive materials in addition to having incendiary properties that can be used against such targets as fossil fuel tanks and the like. It will further be appreciated that in accordance with the invention the projectiles may be made of any size or shape or ballistic property necessary with respect to the destruction of a particular target.

This invention has been described herein in considerable detail in order to comply with the Patent Statutes and to provide those of ordinary skilled in the art with the information needed to apply the novel principles and to construct and use embodiments of the example as required. However, it is to be understood that the invention can be carried out by specifically different devices and that various modifications can be accomplished without departing from the spirit and scope of the invention itself.

All publications and references cited herein are expressly incorporated herein by reference in their entirety.

What is claimed is:

1. A projectile for the destruction of explosive targets comprising:

(a) a projectile shell body having a tapered forward nose section and an aft section;

(b) a pyrogenically activated intermetallic reactive payload in said forward section;

(c) an amount of tracer material in said shell body rearward of and contacting said intermetallic reactive payload for igniting said intermetallic reactive payload.

2. The projectile of claim 1 wherein said tapered nose section includes a penetrator configuration for penetrating target casings.

3. The projectile of claim 1 wherein said intermetallic reactive payload is a powdered metal mixture selected from reactive bi-metallic mixtures.

4. The projectile of claim 3 wherein said intermetallic reactive payload is selected from the group of bi-metallic mixtures consisting of those forming titanium boride (TiB) and nickel aluminide (NiAl).

5. The projectile of claim 4 wherein said bi-metallic mire forms TiB.

6. A method of destroying an explosive target of interest comprising the steps of:

penetrating said target of interest with a projectile shell containing an intermetallic reactive payload pyrogenically activated by a tracer material located rearward of and contacting the payload, the reactive payload being activated in a manner such that high temperature fragments of said payload are distributed into said explosive target.

* * * * *

UNITED STATES PATENT AND TRADEMARK OFFICE

CERTIFICATE OF CORRECTION

PATENT NO. : 6,354,222 B1
DATED : March 12, 2002
INVENTOR(S) : Robert S. Becker et al.

It is certified that error appears in the above-identified patent and that said Letters Patent is hereby corrected as shown below:

Column 1,
Line 20, delete “Well adapted” and replace with -- well adapted --.
Line 39, delete “ace” and replace with -- are --.
Line 62, delete “20MM-40MM” and replace with -- 20mm-40mm --.

Column 2,
Line 34, delete “drawing s” and replace with -- drawings --.
Lines 42 and 66, delete “(2000°C.” and replace with -- (2000°C --.
Line 50, delete “preferably configures” and replace with -- preferably configured --.

Column 3,
Line 3, delete “hat” and replace with -- hot --.
Line 17, delete “rats” and replace with -- rates --.

Column 4,
Line 2, delete “ogive nose section” and replace with -- nose section --.
Line 31, delete “(2000°C.” and replace with -- (2000°C --.
Line 60, delete “combination” and replace with -- combinations --.

Column 6,
Line 22, delete “mire” and replace with -- mixture --.

Signed and Sealed this

Twentieth Day of August, 2002

*Attest:*

*Attesting Officer*

JAMES E. ROGAN
*Director of the United States Patent and Trademark Office*